US006113310A

United States Patent [19]

Hesse, Jr.

[11] Patent Number: 6,113,310

[45] Date of Patent: Sep. 5, 2000

[54] ROAD REPAIR APPARATUS AND METHOD FOR PAVEMENT PATCHING

[76] Inventor: Ronald Hesse, Jr., 10670 Warren Rd., Plymouth, Mich. 48170

[21] Appl. No.: 09/100,834

[22] Filed: Jun. 19, 1998

Related U.S. Application Data

[60] Provisional application No. 60/050,992, Jun. 20, 1997.

[51] Int. Cl.[7] ..... E01C 19/12

[52] U.S. Cl. ..... 404/108; 404/84.05; 404/86

[58] Field of Search ..... 404/84, 84.05, 404/84.1, 86, 108

[56] References Cited

U.S. PATENT DOCUMENTS

| | | | |
|---|---|---|---|
| 1,714,659 | 5/1929 | Chausse . | |
| 1,862,232 | 5/1932 | McLeod . | |
| 1,914,950 | 6/1933 | Kanen . | |
| 2,134,245 | 10/1938 | Carswell . | |
| 3,241,976 | 3/1966 | Rank et al. . | |
| 3,399,609 | 9/1968 | Moore . | |
| 3,519,169 | 7/1970 | Holland . | |
| 3,636,831 | 1/1972 | Davin et al. . | |
| 3,811,787 | 5/1974 | Beaty et al. | 404/84 |
| 3,841,777 | 10/1974 | Domenighetti . | |
| 4,140,420 | 2/1979 | Swisher et al. | 404/84 |
| 4,302,128 | 11/1981 | Thatcher . | |
| 4,310,293 | 1/1982 | Eggleton | 404/105 |
| 4,405,089 | 9/1983 | Taylor . | |
| 4,492,490 | 1/1985 | Christine et al. . | |
| 4,511,284 | 4/1985 | Sterner . | |
| 4,557,626 | 12/1985 | McKay et al. . | |
| 4,571,119 | 2/1986 | Jones et al. | 404/108 |
| 4,575,279 | 3/1986 | Mateja . | |
| 4,577,781 | 3/1986 | Braun . | |
| 4,580,923 | 4/1986 | Brown | 404/84 |
| 4,676,689 | 6/1987 | Yant . | |
| 4,765,772 | 8/1988 | Benedetti et al. . | |
| 4,830,533 | 5/1989 | Miller . | |
| 4,871,025 | 10/1989 | Mayfield et al. . | |
| 5,131,788 | 7/1992 | Hulicsko . | |
| 5,279,500 | 1/1994 | Perrin et al. . | |
| 5,294,210 | 3/1994 | Lemelson . | |
| 5,439,313 | 8/1995 | Blaha et al. . | |
| 5,452,966 | 9/1995 | Swisher, Jr. . | |
| 5,588,776 | 12/1996 | Swisher, Jr. et al. . | |
| 5,590,976 | 1/1997 | Kilheffer et al. . | |
| 5,599,134 | 2/1997 | Macku et al. . | |

*Primary Examiner*—Eileen Dunn Lillis
*Assistant Examiner*—Raymond W Addie
*Attorney, Agent, or Firm*—Gifford, Krass, Groh, Sprinkle, Anderson & Citkowski, P.C.

[57] ABSTRACT

A material spreading apparatus for filling recesses in a generally horizontal surface with a filler material is movable in a forward direction over the generally horizontal surface so as to define a coverage path thereon. The coverage path is comprised of multiple parallel treatment zones. The material spreading apparatus includes a frame, a sensor for sensing the presence of a recess in a generally horizontal surface, and a filler for filling recesses sensed by the sensor. In some embodiments, the sensor includes multiple mechanical sensors supported by the frame. One of the sensors is located in each of the treatment zones and is responsive to the presence of a recess and its associated treatment zone. In some embodiments, the filler includes a retainer and a counter rotating applicator drum. The container releasably holds a portion of the filler material and deposits material onto the counter rotating drum when the sensor senses a recess. The counter rotating drum urges filler material deposited thereon towards a sensed recess. In other embodiments, the sensor is movable with respect to the filler so as to change the distance between the sensor and the filler. A speed sensor triggers an actuator to move the sensor further from the filler when the forward speed of the material spreading apparatus exceeds a predetermined speed limit.

15 Claims, 10 Drawing Sheets

ROAD REPAIR APPARATUS AND METHOD FOR PAVEMENT PATCHING

CROSS-REFERENCE TO RELATED APPLICATIONS

This application claims the benefit of United States Provisional Application having Ser. No. 60/050,992 filed Jun. 20, 1997 for Road Repair Apparatus and Method.

FIELD OF THE INVENTION

This invention relates generally to material spreading apparatus, and more particularly to an apparatus for filling recesses in a generally horizontal surface with a filler material.

BACKGROUND OF THE INVENTION

Our modern highly mobile society has necessitated the use of paved surfaces such as roads, sidewalks, and pathways. These paved surfaces are typically of aggregate composition such as either asphalt pavement or concrete. Unfortunately, wear and seasonal changes lead to damage. The damage is usually to localized areas making pavement patching an economical alternative to complete pavement replacement. The damaged areas are typically irregularly shaped depressions containing broken and pulverized aggregate pavement material. These damaged areas are typically repaired manually, using hot or cold asphalt composition mixtures.

Damaged pavement presents several problems. Once the paved surface is damaged, additional damage becomes more likely. Water and environmental contaminants are able to seep into the aggregate composition further weakening it and setting the stage for more damage. Vehicle tires that pass over damaged areas are often jolted by a recess or ridge causing the vehicle to bounce or jolt, thereby exerting additional force on the surrounding pavement and spreading the damage. Damaged areas also affect the safety of vehicles and pedestrians. Recesses encountered by a vehicle may upset the stability of the vehicle and surprise the driver increasing the likelihood of an accident. Larger recesses may cause damage to vehicles directly such as blown tires, suspension damage or bent wheels. Pedestrians encountering a recess may trip and be injured. Even small damaged areas increase the need for driver and pedestrian alertness, and make the road or pathway less pleasant to use. Therefore, there is a need for economical and effective methods to repair damaged paved surfaces.

The typical repair is made using a truck for delivering a premixed filler material to the damaged area. A worker then shovels the material from the truck into the damaged areas and levels the material with the back of the shovel. This time honored method of pavement patching is both labor intensive and dangerous.

The typical repair approach has additional drawbacks. After a worker fills a damaged area, traffic tends to squash the pavement composition down, thereby reshaping it. As shown in FIG. 2A, the pavement composition often gets pushed towards one end of the hole creating a ramp. The arrow in FIG. 2A indicates the direction of traffic travel. The pavement composition is pushed in the direction of travel to the end of the hole creating the ramp which can be dangerous to passing cars and motorcycles. The ramp can be nearly as upsetting to the vehicles as the original damaged area.

It is preferable that a recess be filled in the manner shown in FIG. 2B. As shown, the recess is filled such that there is an extra portion of filler material adjacent the leading edge of the recess. By filling the recess in this manner, the repair is ready to be run over by vehicular traffic. As the traffic compresses and redistributes the filler material, the repair will become flat as the extra portion of filler material is pushed forward and the filler material becomes compressed. This prevents the formation of a ramp, or at least reduces the size of a ramp, improving the performance of the repair. Ideally, a worker using a shovel can create a repair as shown in FIG. 2B. However, a worker is typically working under less than ideal conditions and it is unlikely that he or she can repeatedly and reliably create an optimal repair. For this reason, there is a need for an apparatus that can repeatedly and reliably repair recesses in paved surfaces in the proper manner.

While the idea of using a sensor to control the metering of paving material is known to the art, as taught for example in U.S. Pat. No. 5,452,696, the ability to meter cementitious or aggregate paving material to a damaged pavement surface has heretofore not been contemplated. It is thus an object of the current invention to provide an apparatus and method for delivering aggregate paving materials in proportional amounts to recesses in a pavement surface while continuously moving.

The use of a series of dispensing nozzles for the automated delivery of liquids to damaged areas of a pavement surface, is taught in U.S. Pat. No. 5,294,210. However, this invention relies on the use of electronic sensors and a computer to control the dispensers. It is an object of the present invention to avoid the need for electronic sensors and computer control in the repair of pavement.

SUMMARY OF THE INVENTION

There is disclosed herein a material spreading apparatus for filling recesses in a generally horizontal surface with a filler material. The material spreading apparatus is movable in a forward direction over the generally horizontal surface so as to define a coverage path thereon. The coverage path is comprised of a plurality of parallel treatment zones. The material spreading apparatus includes a frame, a sensing means for sensing the presence of a recess in the generally horizontal surface, and a filling means for filling recesses sensed by the sensing means. In some embodiments, the sensing means includes a plurality of mechanical sensors supported by the frame. One of the sensors is disposed in each of the treatment zones and each mechanical sensor is responsive to the presence of a recess in its associated treatment zone. The filling means is also supported by the frame. In some embodiments, the filling means has a plurality of filling zones, one filling zone corresponding to each treatment zone. The filling means is in communication with the sensing means so as to deposit filler material in one of the filling zones when the sensing means senses a recess in the corresponding treatment zone. In some embodiments, the filling means includes a container and a counter-rotating application drum. The container is configured to releasably hold a portion of the filler material and deposit the material onto the counter-rotating applicator drum when the sensing means senses a recess. The counter-rotating drum is configured to urge filler material deposited thereon towards a sensed recess. In yet other embodiments, the sensing means is movable with respect to the filling means so as to change the distance between the sensing means and the filling means. A speed sensor senses the speed of forward travel of the material spreading apparatus and triggers an actuator to move the sensing means further from the filling means when the forward speed of the apparatus exceeds a predetermined speed limit.

DESCRIPTION OF THE PREFERRED EMBODIMENT

Figure 1:
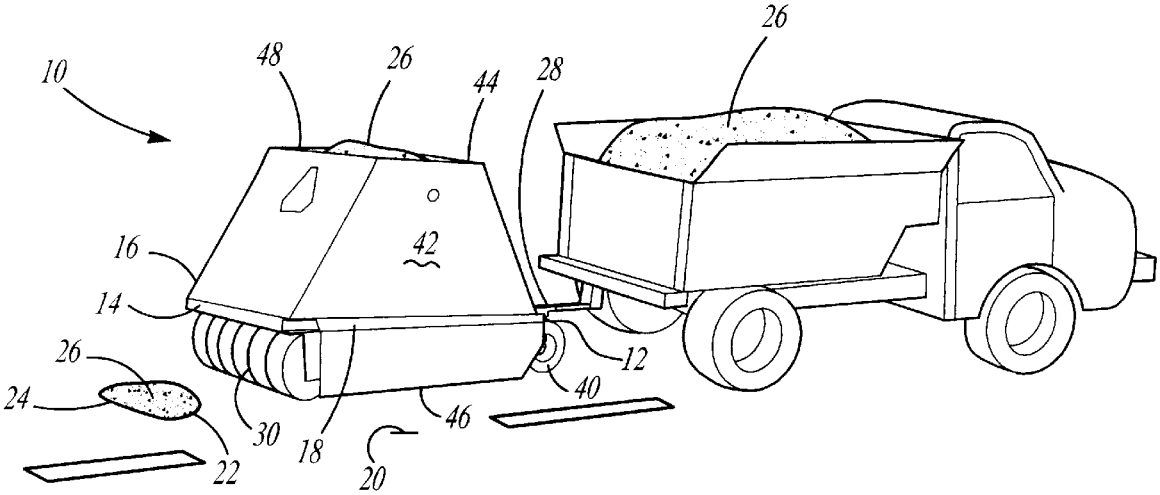
FIG. 1 is a perspective view of a material spreading apparatus according to the present invention being towed behind a vehicle so as to fill recesses.

Referring to the figures, a material spreading apparatus according to the present invention is generally shown at 10. In FIG. 1, the apparatus is shown being towed behind a truck such as a dump truck typically used by road repair crews.

Figure 2A:
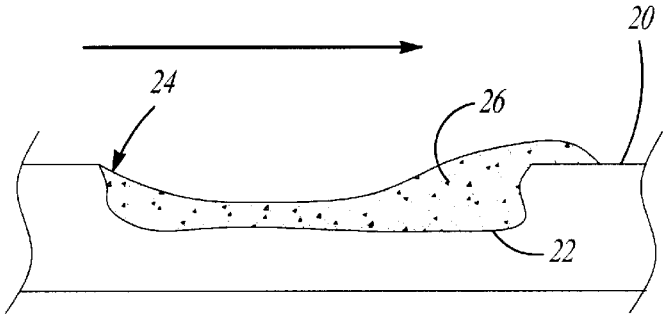
FIG. 2A is a cross-sectional view of a portion of a horizontal surface with a recess that is poorly repaired.
Figure 2B:
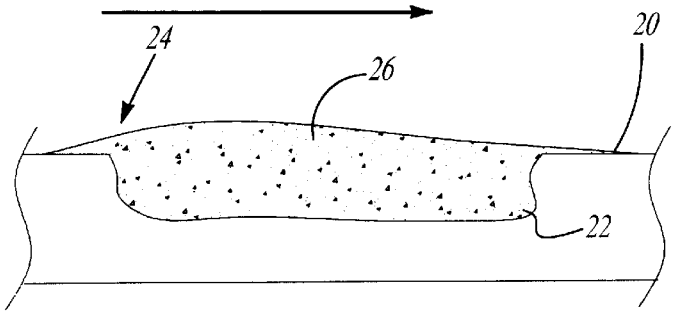
FIG. 2B is a cross-sectional view of a portion of a horizontal surface with a recess that is filled in an improved manner.

As shown, the material spreading apparatus 10 is being towed in a forward direction over a generally horizontal surface 20; in this case a paved road surface which may be made out of asphalt, concrete or other paving materials. In FIG. 1, a repaired recess 22 is shown behind the material spreading apparatus 10. The recess 22 has been repaired by filling it with a filler material 26. Preferably, the material spreading apparatus 10 fills the recess 22 as shown in the cross-sectional view of FIG. 2B. The apparatus 10 completely fills the recess 22 adjacent its leading edge 24 and leaves the recess 22 with a slight amount of additional filler material 26 located adjacent the leading edge 24.

The filler material 26 which is used to repair the recess 22 may be of a variety of types. In a preferred embodiment, the material spreading apparatus 10 fills recesses 22 with an aggregate composition known as cold patch. This is the same material typically used by road repair crews to manually repair recesses using a shovel. Cold patch material does not have to be heated to be workable, but instead remains workable at approximately ambient temperature. As will be clear to one of skill in the art, the preferred embodiment of the material spreading apparatus 10, as described hereinbelow, can be modified to dispense a variety of other materials for the repair of recesses in generally horizontal surfaces. For example, the material spreading apparatus 10 can be used approximately as described to dispense sand or gravel or dirt to fill recesses in a dirt or gravel road. With some modification, the material spreading apparatus can be used to dispense hot patch material or wet concrete. Hot patch material is an aggregate composition that must be heated prior to use for repair of recesses. Typically, a recess must also be pretreated with a tacking agent prior to application of the hot patch material.

Returning to FIG. 1, the material spreading apparatus 10 has a front 12, a rear 14, and a pair of longitudinal sides, a right side 18 and a left side 16, interconnecting the front 12 and rear 14. Drive wheels 30 and support wheels 40 movably support the apparatus 10 on the paved surface 20 with the drive wheels 30 positioned adjacent the rear 14 and the support wheels 40 positioned adjacent the front 12. A tongue 28 extends from the front 12 of the apparatus 10 for attachment to the hitch of the truck. An outer cover 42 substantially covers the material spreading apparatus 10 from front 12 to rear 14 and from side 16 to side 18. The drive wheels 30 and support wheels 40 protrude from the bottom 46 of the cover 42 and the top 44 is open to allow access to a material hopper 48. The material hopper 48 holds filler material 26 and must be periodically refilled from a larger supply, such as in the bed of the truck.

The outer cover 42 serves several purposes. First, it is preferably painted a bright color so that it is highly visible on the road, decreasing the likelihood of an accident. Secondly, because the material spreading apparatus 10 has a variety of moving internal parts, some type of cover is desirable. The outer cover 42 helps reduce exposure of the internal parts to foreign objects which may damage the moving parts. It also reduces the likelihood that persons may come in contact with the moving parts and be injured. The outer cover 42 also improves the appearance of the material spreading apparatus 10 and may be used to display advertising messages or safety indicia.

Figure 3:
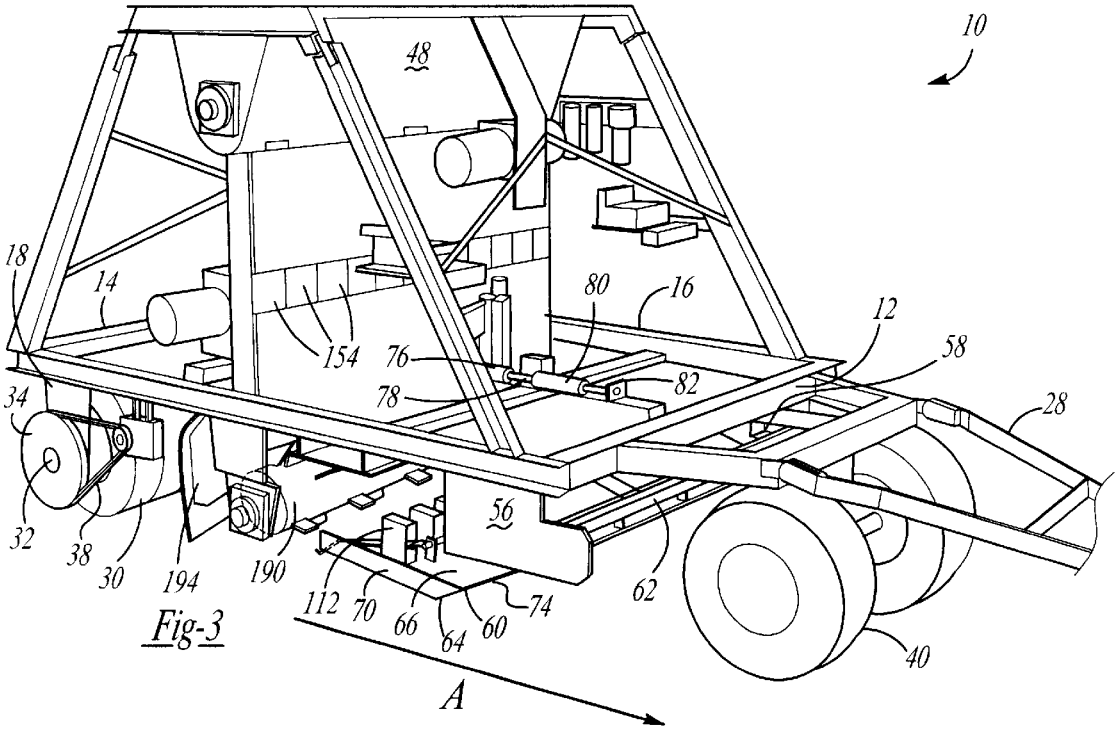
FIG. 3 is a perspective view of a material spreading apparatus according to the present invention with the outer cover removed so as to view the internal parts.
Figure 4:
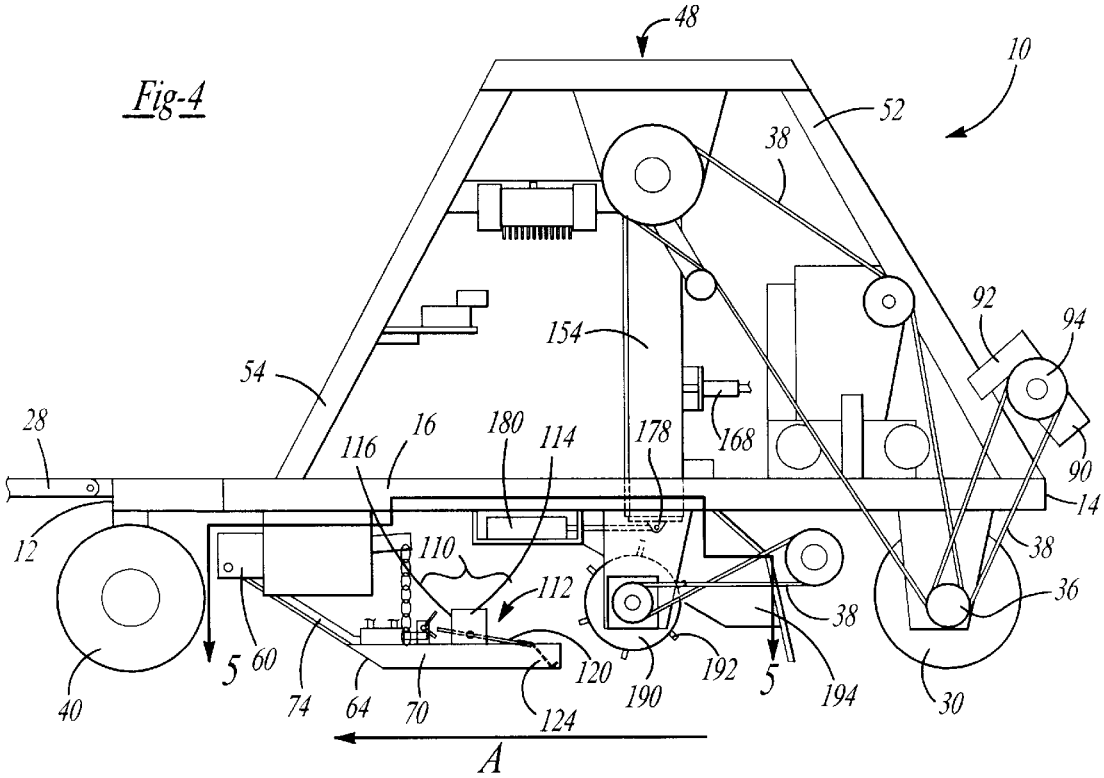
FIG. 4 is a side elevational view of the material spreading apparatus of FIG. 3.
Figure 5:
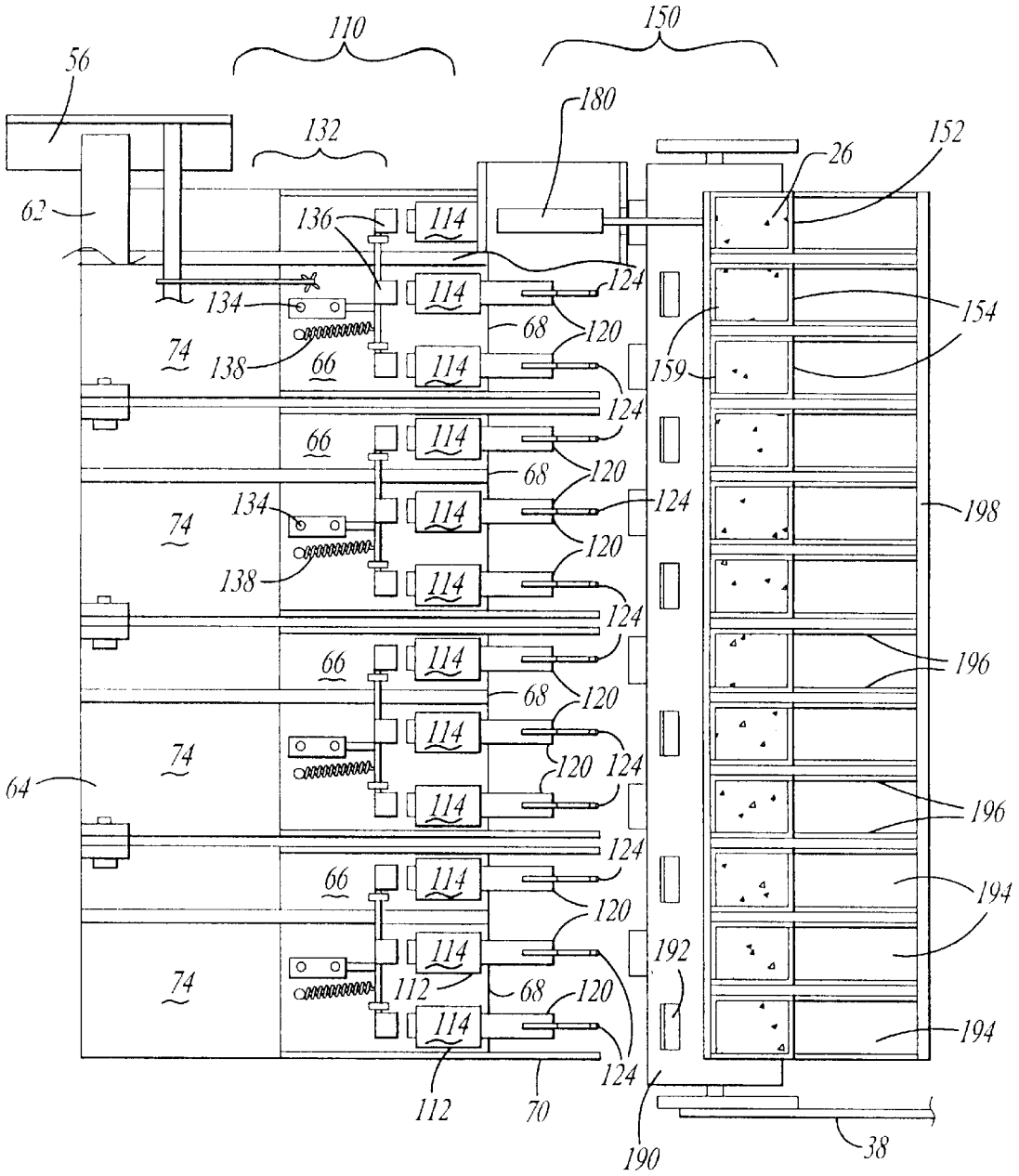
FIG. 5 is a cross-sectional view taken along lines 5—5 of FIG. 4.

Referring now to FIGS. 3–5, the material spreading apparatus 10 includes two major sections. The first is a sensing means 110 for sensing recesses 22 in the generally horizontal surface 20 and the second portion is a filling means 150 for filling the sensed recesses 22 with filler material 26. The sensing means 110 and the filling means 150 are both supported by a frame 52. The frame 52 generally defines the front 12, rear 14, and pair of longitudinal sides 16, 18 of the apparatus 10. The frame 52 is supported by the plurality of drive wheels 30 at its rear 14 and by the pair of support wheels 40 at its front 12. The drive wheels 30 and the support wheels 40 rotate as the apparatus 10 is moved in the forward direction (indicated by arrow A). Preferably, the wheels 30, 40 are tires, such as car tires, supported on rims. The plurality of drive wheels 30 are arranged side by side so as to form a cylinder extending almost the entire width of the apparatus 10. Alternatively, a wide roller could be substituted for the plurality of drive wheels. The drive wheels 30 are solidly mounted on a drive axle 32 which interconnects with the frame 52 at both ends of the cylinder of drive wheels 30. A first drive pulley 34 is fitted to a drive axle 32 at the right side of the apparatus 10, and a second drive pulley 36 is fitted to the drive axle 32 at the left side of the apparatus 10. The drive wheels 30, drive axle 32, and first 34 and second 36 drive pulleys all rotate together as the apparatus 10 is moved in the forward direction A. As can be seen, belts 38 interconnect the drive pulleys 34, 36 with several other rotating parts of the apparatus 10, providing power thereto.

As the apparatus 10 moves forward a over the paved surface 20, it defines a coverage path thereon. This coverage path is a path that has a width equal to the width of the paved surface 20 that the material spreading apparatus 10 is capable of applying filler material 26 to. For clarity of description, the coverage path is defined as being comprised of a plurality of parallel treatment zones. If the longitudinal axis of the apparatus 10 is defined as running front 12 to rear 14, the treatment zones are each generally parallel to the longitudinal axis. The treatment zones are nonoverlapping strips arranged side to side across the width of the apparatus 10 and coverage path.

The embodiment of the material spreading apparatus 10 illustrated and discussed herein is smaller than the embodiment of the apparatus 10 intended for actual use repairing road surfaces. The illustrated embodiment has a coverage path that is approximately four foot wide. This smaller embodiment of the material spreading apparatus 10 is best suited to repairing recesses 22 in a strip of paving material that is narrower than a typical road, such as a pathway. This embodiment was constructed as a demonstration model. The smaller size makes it easier to transport the apparatus to various sites to be demonstrated for potential purchasers. The smaller embodiment is also simpler and less expensive to construct. This embodiment, with the four foot coverage path, is illustrated and discussed herein because of its reduced complexity and size. As will be clear to one of skill in the art, the illustrated embodiment of the material spreading apparatus 10 may be scaled up or scaled down depending on the desired application. A version of the material spreading apparatus 10 intended for use on a road surface would merely have a wider coverage path and therefore have either a greater number of treatment zones or the individual treatment zones would each be of greater width. In the illustrated embodiment, the four foot wide coverage path is divided into twelve equal width treatment zones; each treatment zone being approximately four inches wide.

The sensing means 110 may be constructed in a number of ways but, in the preferred embodiment, comprises a plurality of sensors 112 supported by the frame 52 and spaced apart between the sides 16, 18 of the frame 52 so that one of the sensors 112 is disposed in each of the treatment zones.

The sensors 112 are supported generally toward the front 12 of the frame 52. Each sensor 112 is designed to sense the presence of a recess 22 in its associated treatment zone (also called a sensing zone). Therefore, as the apparatus 10 is moved in the forward direction A, the sensors 112 each respond to the presence of a recess 22 in their respective treatment zone as they pass over it. A very small recess 22 may trigger only a single sensor 112 while a larger recess 22 may trigger several sensors 112.

The filling means 150 for filling the recesses 22 is supported by the frame 52 in a position behind the sensors 112 and ahead of the drive wheels 30. The filling means 150 has a plurality of filling zones, one filling zone corresponding to each treatment zone. Therefore, in the illustrated embodiment, the filling means 150 has twelve filling zones. The filling means 150 is in communication with and activatable by the sensors 112 so as to deposit filler material 26 in one of the filling zones when the sensor 112 disposed in the corresponding treatment zone senses the presence of a recess 22. Therefore, as the material spreading apparatus 10 is moved in the forward direction A over the generally horizontal surface 20, the sensors 112 sense the presence of recesses 22 and the filling means 150 fills those recesses 22.

Turning now to a more detailed description, the frame 52 includes a main portion 54 and a sensor support 60 depending therefrom for supporting the plurality of sensors 112. The sensor support 60 is designed to support the sensors 112 at a position spaced above the paved surface 20 so that the sensors 112 can detect changes in the surface 20 indicative of damage. The sensor support 60 is made up of several parts. A support bar 62 runs laterally from one side of the frame 52 to the other. The lateral support bar 62 is interconnected with the main portion 54 of the frame 52 at its ends and is supported generally parallel to the paved surface 20 near the front 12 of the apparatus 10. Multiple skids 64 are pivotally interconnected with the support bar 62 with each skid 64 supporting one or more of the sensors 112. In the preferred embodiment, four skids 64 are provided and each one supports three of the sensors 112. The skids 64 are arranged side by side across the width of the material spreading apparatus 10. Each skid 64 is slightly less than one foot wide so as to provide clearance between adjacent skids 64.

Each skid 64 has a platform 66 for supporting the sensors 112 and a pair of runners 70 depending from each side of the platform 66. The runners 70 are configured to contact the paved surface 20 thereby supporting the platform 66 up off of the paved surface 20 by a set amount. The platform 66 is a flat piece of metal, which in its normal position is generally parallel to the paved surface 20. Each skid 64 further has a yoke portion 74 interconnecting the platform 66 with the support bar 62. The yoke 74 extends upwardly and forwardly from the platform to pivotally interconnect with the lateral support bar 62. By independently pivotally interconnecting the four skids 64 with the support bar 62, each skid 64 is able to follow a portion of the paved surface 20 directly under it without affecting the position of the adjacent skids 64. This is particularly advantageous due to the fact that most paved surfaces 20 are not absolutely flat and horizontal, even when undamaged. For example, many roads designed for vehicle travel have some crown to the road; a crown is a convex curvature of the road surface from side to side. Some crown may be purposely designed into a road to aid drainage of water away from the center of the road to the sides of the road. Also, heavy vehicle traffic often causes the surface to become lower where the vehicle tires contact the pavement. In cross section, such a road surface appears to have two dips in each of its lanes. If the sensor support portion 60 of the frame 52 consisted of only a single skid 64, the highest area of a road surface 20 would push the entire skid 64 upwardly creating a significant gap between the road surface 20 and portions of the sensor support 60. Ideally, the platform 66 of each skid 64 is supported a short distance above the road surface 20 by the runners 70. The sensors 112 are designed to sense the distance between the area of the platform 66 where they are mounted and the paved surface 20 below the platform 66. Therefore, for proper performance of the sensors 112, the skids 64 must be able to closely follow the road surface 20. If a single skid 64 were as wide as the entire covered path, any dip or crown in the paved surface 20 would cause portions of the platform 66 to be at different distances from the paved surface 20. By making the skids 64 less than a foot wide, each one is able to follow the paved surface 20 more closely.

Turning now to the sensors 112, several types may be used to detect changes in the paved surface 20 indicative of damage. In the preferred embodiment, mechanical sensors 112 are used. By "mechanical sensors" it is meant that the sensors 112 physically contact the paved surface 20 to detect changes therein. These mechanical sensors 112 also include electrical switches 128 which are triggered by movement of the portion of the mechanical sensor 112 that contacts the paved surface 20. Obviously, non-contact, non-mechanical sensors may also be used to detect changes in the paved surface 20. Mechanical sensors 112 are used in the preferred embodiment due to their simplicity, durability, and low cost.

Figure 6:
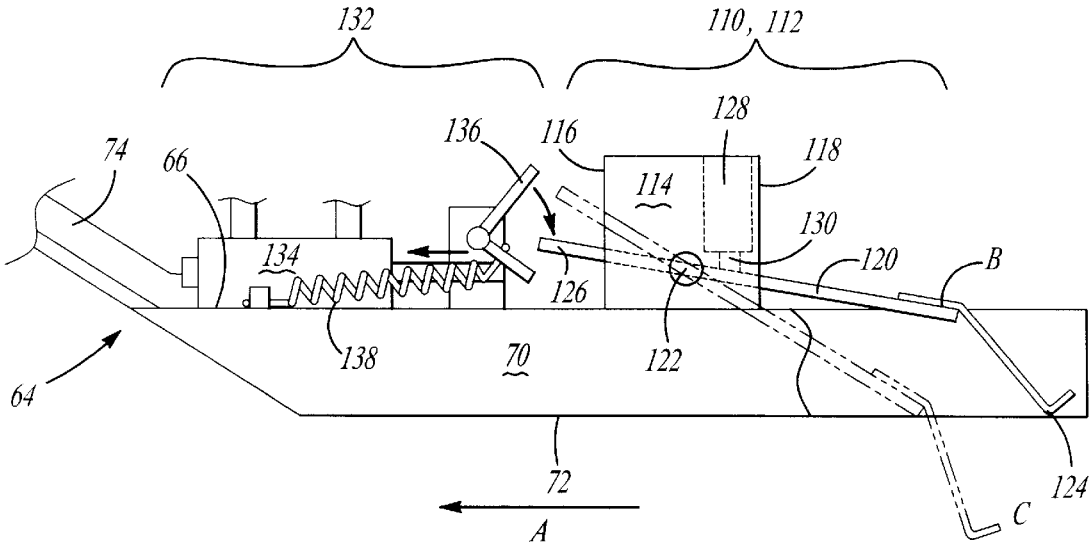
FIG. 6 is a side elevational view of a sensor skid for the material spreading apparatus of the present invention.

Each mechanical sensor 112 has a housing 114 which is mounted to the platform 66 of one of the skids 64. The housing 114 is generally box-like with an open front 116 and back side 118. A drag member 120 is pivotally interconnected with the housing 114. Each drag member 120 pivots around a lateral pivot axis 122 and has a contact end 124 for contacting the paved surface 20. The sensor housings 114 are mounted adjacent the rear-most edge 68 of the platform 66 of the skids 64. The drag member 120 extends from the housing 114 beyond the rear edge 68 of the platform 66 and downwardly to contact the paved surface 20. As shown in FIG. 6, when the skid 64 is resting on an undamaged portion of the paved surface 20, the contact end 124 of the drag member 120 is in the same plane as the bottom edge 72 of the runners 70 of the skid 64. This position is indicated as B in FIG. 6. When the skid 64 is positioned over a recess 22, the drag member 120 pivots so that the contact end 124 is lower than the plane containing the bottom edge 72 of the runners 70. This position is indicated as C in FIG. 6. The sensor housing 114 supports a switch 128 which has a trigger 130 extending downwardly therefrom for contacting the drag member 120 near to the pivotal axis 122. As the drag member 120 pivots downwardly from position B to position C, the trigger 130 is allowed to extend outwardly from the switch 128, thereby triggering the switch 128. Therefore, the switch 128 triggers when the contact end 124 of the drag member 120 falls into a recess 22. The switch 128 is preferably adjustable so that the movement required to trigger the switch 128 can be adjusted. Thereby, the switch 128 can be adjusted such that it does not trigger until the contact end 124 of the drag member 120 falls into a recess 22 having a predetermined depth. For example, a repair crew may wish to set the machine to only trigger and fill recesses 22 that are at least one and half inches deep. The switches 128 would be adjusted such that they do not trigger until the contact end 124 of the drag members 120 falls at least one and half inches below the plane containing the bottom edges 72 of the runners 70.

The switches 128 with the adjustable triggering points may be of various types and designs. A preferred design is a plunger type switch which triggers when the plunger, or trigger 130, is allowed to extend outwardly more than a predetermined amount. In FIG. 6, the position marked as B would correspond to the plunger type switch 128 having the trigger 130 depressed sufficiently to prevent the switch 128 from triggering. The position marked as C would correspond to a position where the trigger 130 has extended outwardly from the plunger type switch 128 sufficiently to allow the switch 128 to trigger. The switch 128 could alternatively be located on the opposite side of the lateral pivot axis 122 of the drag member 120. In that case, a switch 128 would be used which would trigger when the trigger 130 is depressed beyond a certain point.

The switch 128 may be an electrical switch, that when triggered makes or breaks contact between a pair of wires. The switch 128 may also be a pneumatic or hydraulic switch which makes or breaks a connection between a pair of tubes. The switch 128 allows each mechanical sensor 112 to control other parts of the material spreading apparatus 10.

Figure 7:
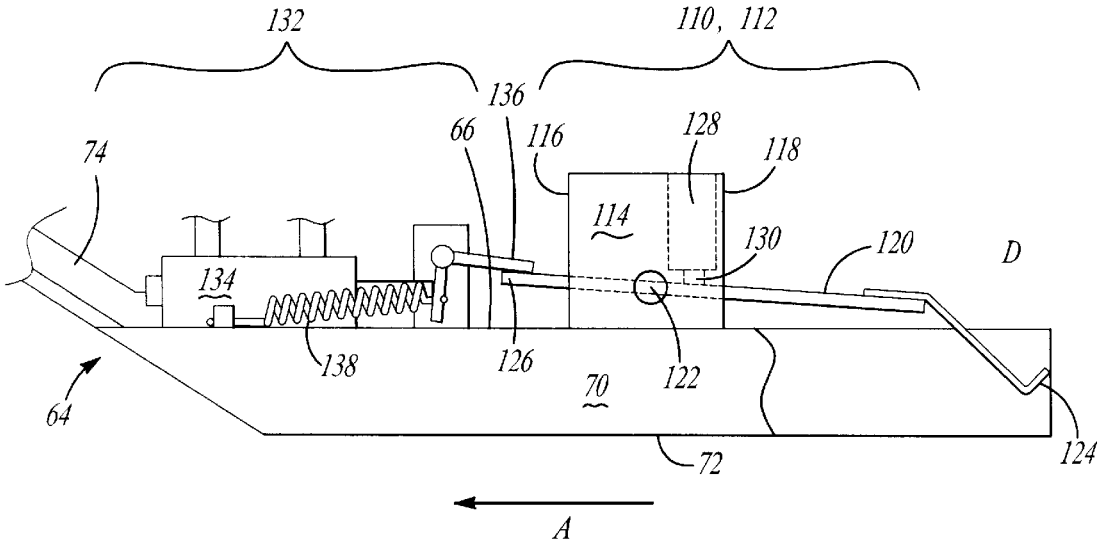
FIG. 7 is a side elevational view of the sensor skid of FIG. 6 showing a sensor locked out for transport.

Referring to FIGS. 6 and 7, some embodiments of the present invention include a lock-out system 132 that locks the mechanical sensors 112 and prevents them from triggering. In the illustrated embodiment, the lock-out system 132 includes a solenoid 134 and a pivotally mounted lever 136. The lever 136 is mounted just ahead of the mechanical sensor 112 and has an upward position where it does not interfere with the drag member 120 and a downward position where it prevents the drag member 120 from pivoting downwardly. The drag member 120 includes a second end 126 which is opposite to the contact end 124. This second end 126 extends out of the front 116 of the sensor housing 114 and moves upwardly and downwardly as the drag member 120 pivots between the untriggered B and triggered C positions. The lever 136 of the lock-out system 132 is mounted just ahead of the second end 126 of the drag member 120 and pivots downwardly so as to block movement of the second end 126. The solenoid 134 is mounted adjacent the lever 136 and pushes the lever 136 to its upward position where it does not interfere with the drag member 120. When a user wishes to lock-out the mechanical sensors 112, the solenoid 134 is triggered which allows the lever 136 to rotate downwardly, as shown in FIG. 7. When the lever 136 of the lock-out system 132 moves to its downward position, the second end 126 of the drag member 120 is pushed downwardly, thereby lifting the contact end 124 of the drag member 120 off of the paved surface 20. The contact end 124 is thereby held up above the plane containing the bottom edges 72 of the runners 70 of the skids 64. The locked out position of the drag member 120 is marked as D. The lock-out system 132 also includes a spring 138 which urges the lever 136 downwardly when the solenoid 134 retracts. As will be clear to one of skill in the art, this lock-out system 132 may be implemented in many different ways. For example, the switch 128 itself may have a lock-out which prevents it from triggering. Also the wiring or plumbing to the switch 128 may be turned off when it is desired that the sensors 112 do not trigger.

The lock-out system 132 is used when it is desired that the sensors 112 do not trigger. This is desirable when the material spreading apparatus 10 is merely being transported from one location to another. In addition to the lock-out system 132 disabling the sensors 112, the skids 64 themselves may be lifted out of contact with the paved surface 20. A cable or chain 140 preferably extends upwardly from each skid 64 to an actuator (not illustrated), that when activated retracts the cable or chain 140, thereby lifting the skids 64 out of contact with the paved surface 20. In use, the road repair crew may come to a section of road which does not require repair. At that point, it is unnecessary to continue to drag the skids 64 and the contact ends 124 of the sensors 112 along the pavement 20. Preferably, the sensors 112 are then locked out and the skids 64 are raised. Obviously, the runners 70 and the contact ends 124 of the drag members 120 are wear surfaces and their exposure to the paved surface 20 should be minimized. It is preferred that these wear surfaces are replaceable for easy maintenance of the material spreading apparatus 10. As shown, the contact end 124 of each drag member 120 is actually a separate piece. This separate piece is preferably detachable from the remainder of the drag member 120 so that it may be replaced. The runners 70 are also preferably replaceable as they wear. This can be achieved in several ways. The runners 70 may have a lower member placed at their bottom edges 72 that serves as the wear surface and is removable and replaceable.

Alternatively, the wear surfaces may be eliminated by the use of rolling members, such as small wheels. For example, the skids 64 may have a series of small wheels supporting them in place of the runners 70. Also alternatively, each drag member 120 may have a small wheel located at its contact end 124.

Referring primarily now to FIGS. 8–11, but also to FIGS. 3–5, a preferred embodiment of the filling means 150 for the material spreading apparatus 10 is illustrated and described. In general terms, the filling means 150 includes two major sections. The first is a container 152 which is configured for releasably holding a portion of the filler material 26. The other is a counter rotating applicator drum 190, positioned beneath the container 152. The container 152 is in communication with and activatable by the sensors 112 so as to deposit filler material 26 onto the counter rotating applicator drum 190 when the sensors 112 sense the presence of a recess 22 in one of the treatment zones. The counter rotating drum 190 is configured to urge filler material 26 deposited thereon towards the sensed recess 22.

Figure 8:
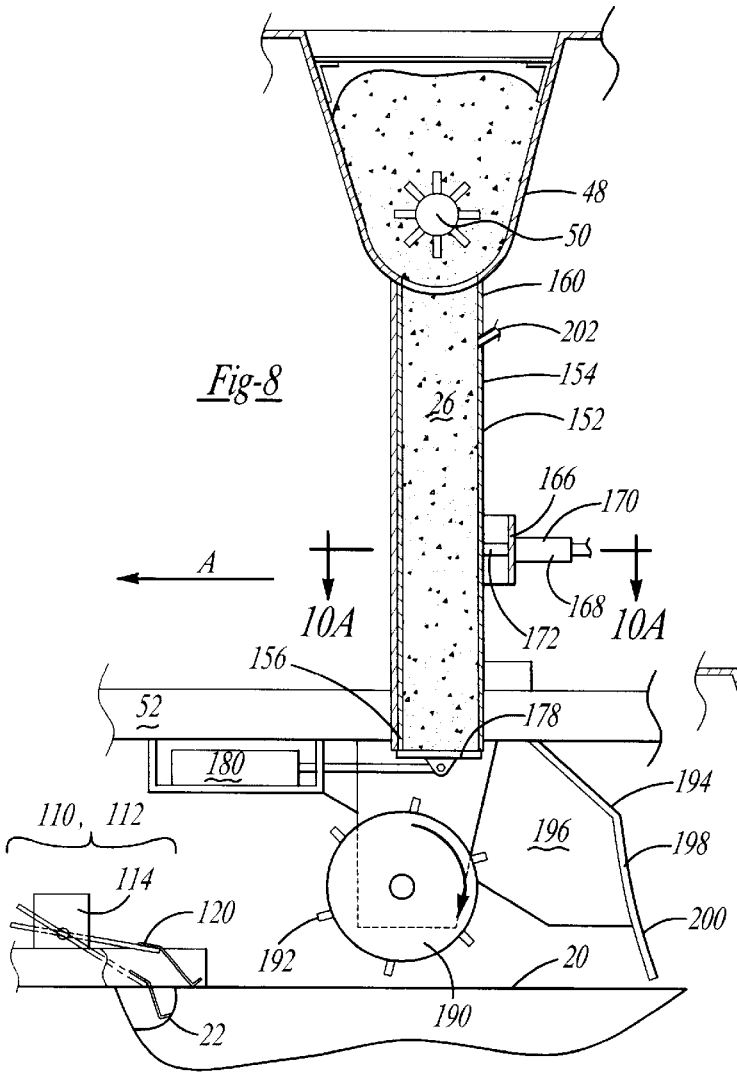
FIG. 8 is a cutaway side view of a portion of the material spreading apparatus showing one embodiment of the filling means prior to deposit of filler material.
Figure 9:
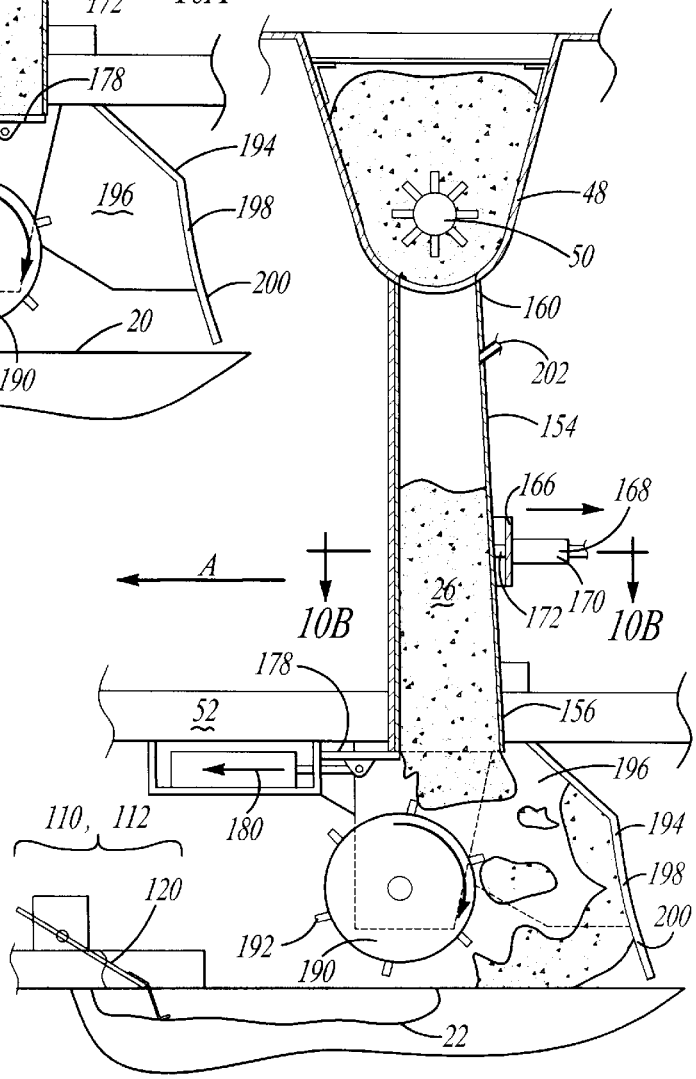
FIG. 9 is a cross-sectional side view of the filling means of FIG. 8 showing filler material being deposited.
Figure 10A:
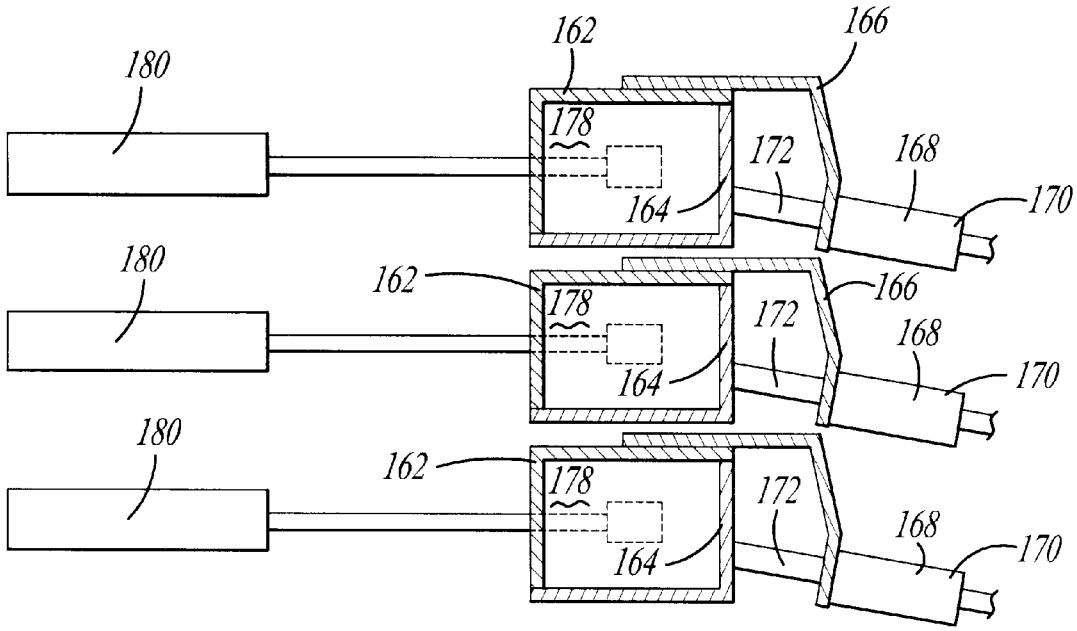
FIG. 10A is a cross-section of the filling means of FIG. 8 taken along lines 10A—10A.
Figure 10B:
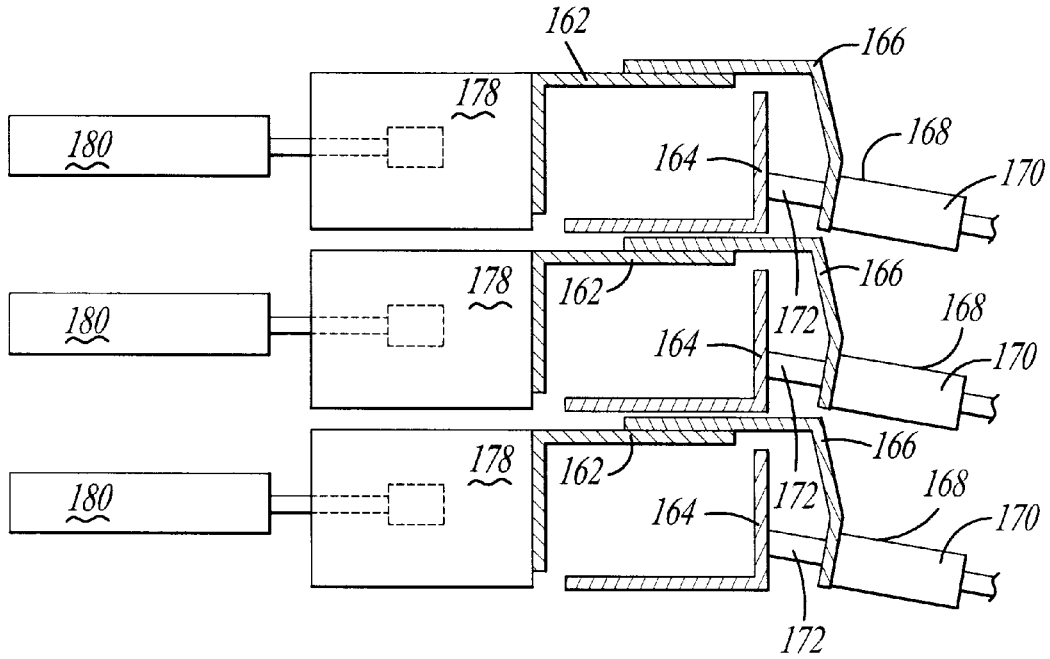
FIG. 10B is a cross-section of the filling means of FIG. 9, taken along lines 10B—10B.

In the preferred embodiment, the container 152 is actually made up of a plurality of generally vertical tubes 154 positioned side by side across the material spreading apparatus 10. The number of tubes 154 corresponds to the number of treatment zones, in this case 12. Each tube 154 is located directly above its corresponding treatment zone (also called a filling zone) so that filler material 26 released by each tube 154 falls toward its corresponding treatment zone. Preferably, each tube 154 has a generally rectangular cross section as best shown in FIGS. 5, 10A and 10B. As shown in FIG. 8, each tube 154 is configured to hold a portion of filling material 26. The lower end 156 of each tube 154 is closed off by a movable door 178. The door 178 is moved by a door actuator 180. The upper end 160 of each tube 154 is connected to the filler material hopper 48 with an agitator 50 therein. The hopper 48 contains a larger portion of filler material 26 that the agitator 50 keeps stirring. The agitator 50 is rotatably driven by a long belt 38 driven by the second drive pulley 36 on the drive axle 32. The filler material 26 falls from the hopper 48 into the tubes until the tubes are full. The hopper 48 is kept full by a worker shoveling additional filler material 26 into the hopper 48 or by an automatic filling means.

The door actuator 180 moves the door 178 from a position covering the lower end 156 of the tube 154 to a position uncovering the lower end 156 of the tube 154 when actuated by a sensor 112 disposed in the corresponding treatment zone. When the sensor 112 senses the presence of a recess 22, the door actuator 180 moves the door 178 so as to uncover the lower end 156 of the tube 154 located above the corresponding treatment zone. This allows filler material 26 contained in the tube 154 to fall downwardly onto the counter rotating applicator drum 190.

The counter rotating applicator drum 190 is preferably positioned side to side in the apparatus 10 and rotates in a direction opposite to the direction of rotation of the drive wheels 30 about an axis of rotation parallel to the paved surface 20 and the drive axle 32. As shown, the counter rotating drum 190 is driven by a series of belts 38 driven from the first drive pulley 34 on the drive axle 32. Therefore, filler material 26 falling onto the counter rotating applicator drum 190 is urged toward the back of the material spreading apparatus 10. This is the situation illustrated in FIG. 9. The counter rotating applicator drum 190 preferably rotates slightly faster than the rotational speed of the drive wheels 30 thereby tending to fling filler material 26 in a rearward and downward direction. This helps the material spreading apparatus 10 to reliably and completely fill the rearmost portion of a recess 22 in a surface 20. The applicator drum 190 preferably includes a plurality of paddles 192 disposed on its surface for catching and flinging the filler material 26.

It is desirable that the filler material 26 released by each tube 154 is applied primarily to its corresponding treatment zone. The preferred embodiment of the filling means 150 includes a guide chute 194 for each treatment zone. The guide chutes 194 are defined by a series of dividers 196 positioned at the boundaries of the treatment zones and a rear guide 198 running laterally side to side at a position behind the applicator drum 190. Each divider 196 is a sheet of metal positioned vertically between two tubes 154 and extending downwardly to the counter rotating drum 190. The dividers 196 guide filler material 26 released from each tube 154 from spilling over into an adjoining treatment zone. The dividers 196 each extend back from the counter rotating drum 190 until they intersect the rear guide 198 which defines the rearward limit of the guide chute 194. Filler material 26 being flung from the counter rotating drum 190 either directly travels to the paved surface 20 or is flung into the rear guide 198 from where it falls to the pavement. The dividers 196 extend downwardly toward the paved surface 20 but stop so as to leave a space. The rear guide 198 extends downwardly until it contacts or almost contacts the paved surface 20. Preferably the bottom portion 200 of the rear guide 198 is a flexible material. It has been found that a rigid rear guide 198 tends to push filler material 26 beyond the leading edge 24 of a recess 22 preventing a good fill. The flexible bottom portion 200 allows the rear guide 198 to partially flex allowing filler material 26 to remain in place. The rear guide 198 preferable angles rearwardly as it extends down. This also improves the application of filler material 26 to a recess 22.

The cold patch filler material for which the preferred embodiment is designed is very sticky and therefore resists falling out of the tube 154 when the door 178 opens. Therefore, an additional release mechanism is preferably also included. Each tube 154 is formed from two pieces. The tubes are formed from two pieces lengthwise so that each tube 154 may be opened along its vertical length. This can best be seen in FIGS. 10A and 10B which are cross sectional views of three tubes 154. FIG. 10A shows the tubes 154 in their closed, material holding position and FIG. 10B shows the tubes 154 in their open, material releasing position.

Each tube 154 is preferably split such that each half of the tube 154 comprises two sides of a rectangle. Therefore, when the two pieces are placed together, as in FIG. 10A, a rectangular tube is formed. The two tube halves are both supported by the frame 52 such that they can be moved relative to one another. This can be accomplished in several ways. Preferably, both halves of each tube 154 are separately supported near their upper ends 160 so that each can move relative to the other. A bracket 166 holding the body 170 of a tube actuator 168, a pneumatic cylinder, is attached to a first half 162 of each tube 154 with the actuator rod 172 of the tube actuator 154 connected to the second half 164 of the tube 154. The tube actuator 168 has two positions defined as an unactuated position and an actuated position. In its unactuated position, the actuator rod 172 of the tube actuator 168 is extended thereby holding the two tube halves 162, 164 together. When the tube actuator 168 is actuated, it retracts the actuator rod 172 into the body 170 thereby pulling the first 162 and second 164 halves of the tube 154 away from each other.

Combining the actions of the door actuators 180 and the tube actuators 168, the tubes 154 have two positions. In their closed position, the tube actuator 168 holds the second half 164 of the tube against the first half 162 of the tube 154 and the door actuator 180 positions the door 178 to close off the lower end 156 of the tube 154. The other position is an open position. In the open position, the tube actuator 168 pulls the first 162 and second 164 halves of the tube 154 away from each other, splitting the tube 154 open lengthwise, and the door actuator 180 moves the door 178 to a position uncovering the opening at the lower end 156 of the tube 154. As the tube 154 moves from its closed to its open position, filler material 26 occupying the tube 154 is released causing it to fall downwardly onto the counter rotating applicator drum 190. The tube actuators 168 preferably separate the two tube halves 162, 164 rather violently thereby shaking the tube halves 162, 164 further encouraging release of filler material 26.

The tubes 154 are preferably tapered so that they are larger near their lower ends 156 than near their upper ends 158. This also encourages release of filler material 26. The tubes 154 may also have cross sections other than a rectangle. However, the rectangular cross section is currently preferred as it maximizes the volume of the tubes within the limited space available.

Figure 11:
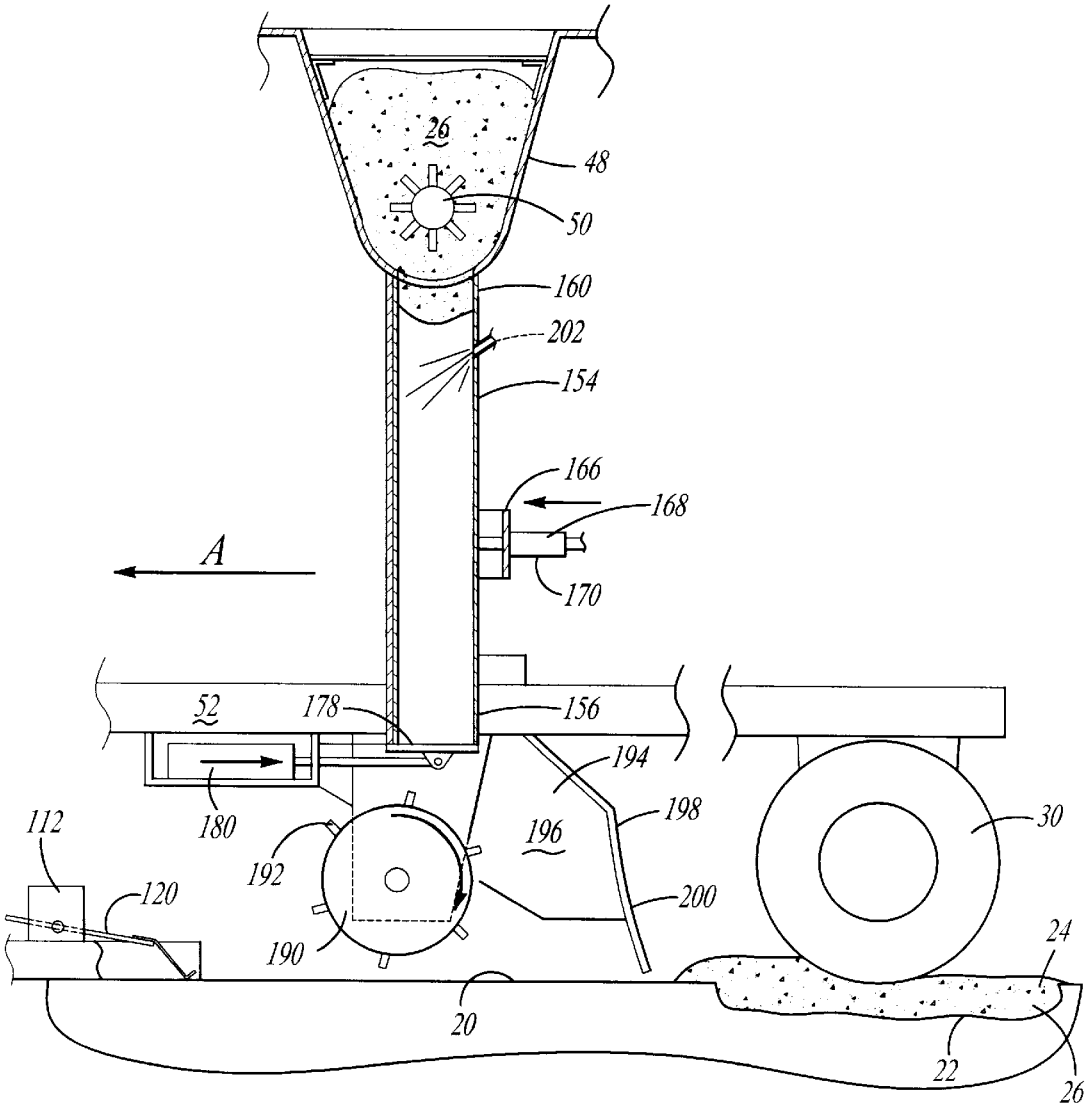
FIG. 11 is a cross-sectional side view of the filling means of FIG. 8 following deposit of filler material.

Referring now to FIG. 11, the filling means 150 is shown following release of the filler material 26. The mechanical sensor 112 has returned to its untriggered position and the door actuator 180 and tube actuator 168 have returned the tube 154 to its closed position. Immediately following closure of the tube 154, a sprayer 202 injects a small quantity of a release agent in the tube 154 preferably coating the walls of the tube 154. The release agent helps to reduce the propensity of the filler material 26 to stick to the walls of the tube 154.

Figure 16:
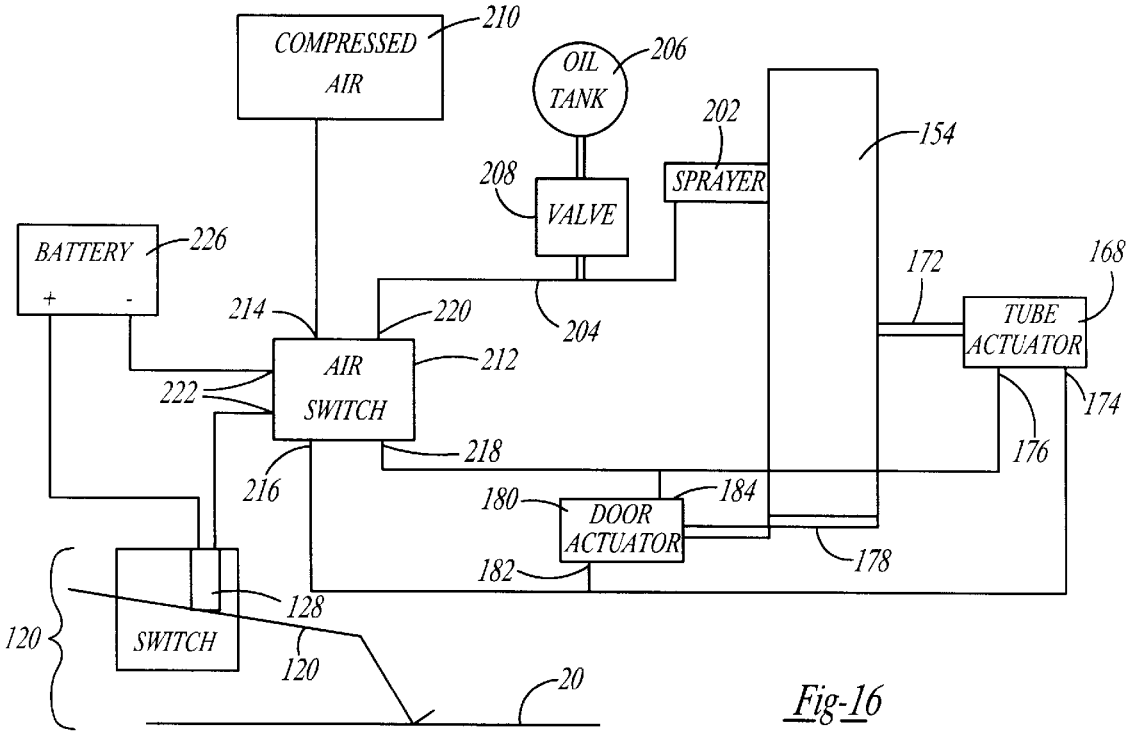
FIG. 16 is a diagram showing one approach to interconnecting a sensor and the filling means of FIG. 8.

Referring now to FIG. 16, the interconnection and operation of the sensing means 110 and filling means 150 of the material spreading apparatus 10 will be more fully described. The apparatus 10 preferably uses compressed air to operate or may alternatively rely on hydraulic or electric power. Preferably, the material spreading apparatus 10 will be towed behind a road repair vehicle which is capable of providing compressed air to the apparatus 10. Alternatively, the apparatus 10 may include an onboard air compressor to provide compressed air. Regardless of the source, the compressed air 210 is connected to an air switch 212 using a compressed air line. The air switch 212 in turn controls the door actuator 180 and the tube actuator 168 and is triggered by the mechanical sensor 112. The air switch 212 has a pair of electrical contacts 222, an inlet port 214, and a first 216 and second 218 outlet port. Compressed air is connected to the inlet port 214. The door actuator 180 and the tube actuator 168 are both double acting pneumatic cylinders and have first inlets 182, 174 and second inlets 184, 176. The first outlet port 216 of the air switch 212 is connected to the first inlets 182, 174 of the door actuator 180 and tube actuator 168. The second outlet port 218 of the air switch 212 is connected to the second inlets 184, 176 of the door actuator 180 and tube actuator 168. When compressed air is provided to the first inlet 182 of the door actuator 180, the door actuator 180 extends thereby moving the door 178 into a position covering the opening at the lower end 156 of the tube 154. When compressed air is released from the first inlet 182 and applied to the second inlet 184, the door actuator 180 retracts causing the door 178 to move to a position uncovering the opening in the lower end 156 of the tube 154. Likewise, when compressed air is provided to the first inlet 174 on the tube actuator 168, the actuator extends thereby moving the second half 164 of the tube 154 against the first half 162 of the tube 154, closing the tube. When compressed air is released from the first inlet 174 and applied to the second inlet 176, the actuator 168 retracts pulling the second half 164 of the tube 154 away from the first half 162 of the tube 154, opening the tube.

The air switch 212 is controlled by power connected to its electrical contacts 222 and has two positions. In its first position, its inlet port 214 and its first outlet port 216 are interconnected thereby providing compressed air to the first inlet ports 174, 182 on the actuators 168, 180. When the air switch 212 is moved to its second position, it interconnects its inlet port 214 with its second outlet port 218 thereby providing compressed air to the second inlet ports 176, 184 of the actuators 168, 180. When the air switch 212 moves from one position to another, compressed air in the line connected to the outlet port no longer interconnected with the inlet port is allowed to bleed off. Therefore, when compressed air is provided to one of the outlet ports, compressed air is released from the other outlet port.

The air switch 212 may be configured to the number of ways, but in the illustrated embodiment, it moves from its first position to its second position when power is applied to its electrical contacts 222. A power source, such as a battery 226, is provided and one of its terminals is connected to one of the contacts 222 of the air switch 212. The other terminal of the battery 226 is connected to the switch portion 128 of the mechanical sensor 112 which is in turn wired to the other contact 222 of the air switch 212. Therefore, when the mechanical sensor 112 is triggered, it interconnects the positive terminal of the battery 226 with the second electrical contact 222 of the air switch 212 thereby activating the air switch 212. Therefore, when the mechanical sensor 112 detects a recess 22 and triggers its switch 128, the air switch 212 is actuated causing it to move from its first position to its second position. This in turn causes the door actuator 180 to open the door 178 and the tube actuator 168 to open the tube 154.

The previously discussed sprayer 202 is also activated by compressed air. As stated earlier, the air switch 212 bleeds off compressed air from the outlet port not currently connected to the compressed air source 210. It does this by bleeding air off through one or more bleed valves. One bleed valve 220 is illustrated. When the air switch 212 moves from its second position to its first position, thereby closing the tube 154, the compressed air previously applied to the second outlet port 218 is bled off through the illustrated bleed valve 220. This bleed valve 220 is connected to an air line 204 running to the sprayer 202 disposed in the side of the tube 154. An oil tank 206 is interconnected with the sprayer line 204 between the air valve 212 and the sprayer 202 so that oil enters the sprayer line 204 from the oil tank 206. A one-way valve 208 in the line between the oil tank 206 and the sprayer line 204, allows oil to flow out of the oil tank 206 into the sprayer line 204 but does not allow compressed air or oil to flow back up into the tank 206. Thereby, oil comes down from the oil tank 206 into the sprayer line 204 until the bleed valve 220 provides a burst of compressed air to the sprayer line 204. At this point the burst of compressed air forces the oil out of the line 204 through the sprayer 202 and into the tube 154. Some provision is necessary to prevent oil from running from the oil tank 206 into the air switch 212 and out of the sprayer 202. Preferably, the sprayer line 204 is routed so as to have a low point into which oil can run. The sprayer line 204 is positioned such that this low point is located directly below the oil tank 206 between the air switch 212 and sprayer 202. The sprayer 202 is preferably positioned above the level of the oil tank 206 so that oil is not allowed to continuously run out of the oil tank 206, through the sprayer line 204, and out of the sprayer 202. In this way, oil is released by the sprayer 202 only when a burst of compressed air is released from the air switch bleed valve 220.

The interconnection illustrated in the diagram of FIG. 16 is but one of several ways the material spreading apparatus 10 may be made to operate. Obviously, other types of switches, valves and plumbing as well as different forms of power, may be used to interconnect the sensors and the filling means. Also, the system illustrated in FIG. 16 only covers a single sensor 112 and a single tube 154 with its corresponding door actuator 180 and tube actuator 168. Obviously, each tube 154 and corresponding sensor 112 must also be interconnected in a similar manner. Thereby, when a sensor 112 is triggered by the presence of a recess 22, that sensor 112 can immediately trigger the door actuator 180 and tube actuator 168 for the tube 154 located above the corresponding treatment zone.

Figure 12:
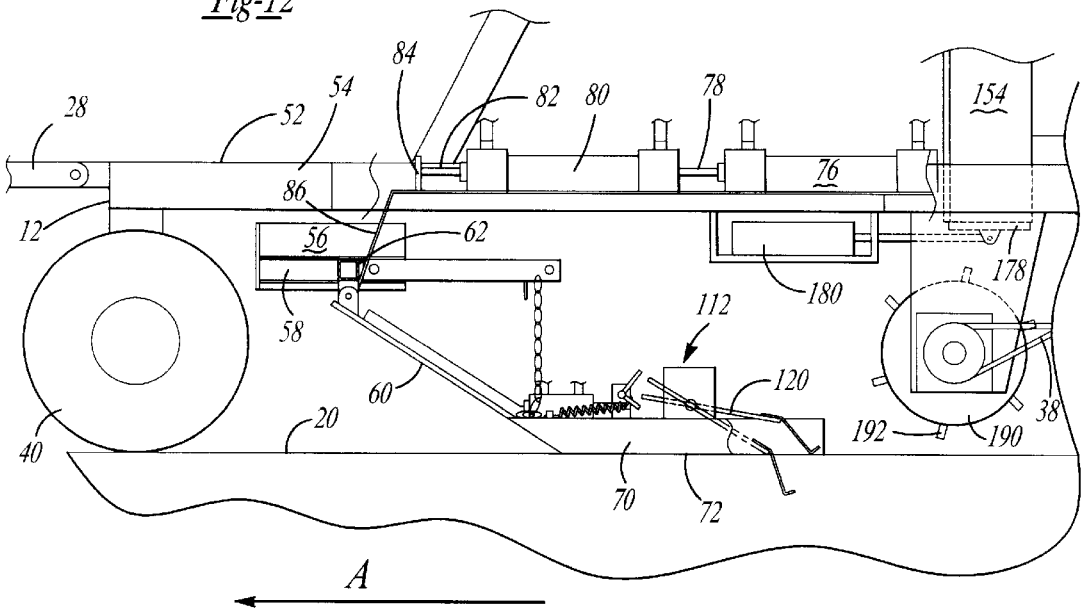
FIG. 12 is a side view of a portion of the material spreading apparatus according to the present invention showing one embodiment of an actuator system for moving the sensing means relative to the filling means.
Figure 13:
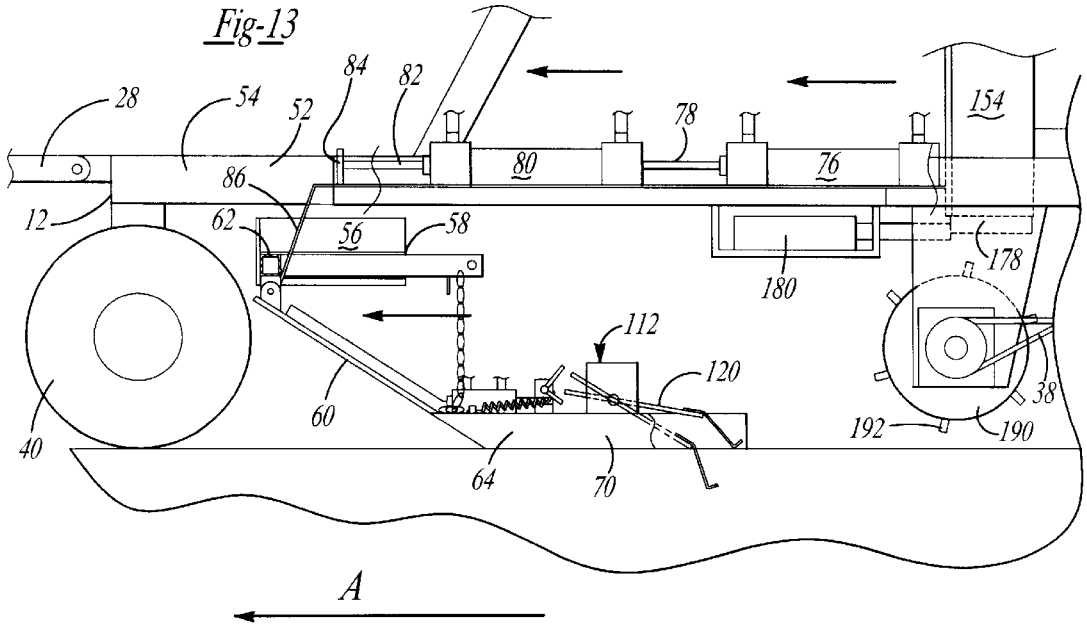
FIG. 13 is a side view of the actuator system of FIG. 12 showing the sensing means moved to its forwardmost position.

Referring now to FIGS. 12 and 13, an additional aspect of the present invention is shown. As discussed previously, the skids 64 supporting the sensors 112 are pivotally connected to a support bar 62 which is interconnected with the main portion 54 of the frame 52. As can be seen in FIGS. 12 and 13, the support bar 62 is slidably interconnected with the main portion 54 of the frame 52 at each of its ends. The main portion 54 of the frame 52 includes a pair of brackets 56 with longitudinal slots 58 configured to accept the ends of the support bar 62. Therefore, the support bar 62 may be slid forwardly and backwardly relative to the main portion 54 of the frame 52, all the while remaining parallel to the paved surface 20. Since the skids 64 are interconnected with the support bar 62, sliding the support bar 62 longitudinally changes the position of the skids 64 relative to the remainder of the material spreading apparatus 10. Of particular interest is the fact that moving the support bar 62 changes the distance between the sensors 112 and the counter rotating applicator drum 190. Sliding the support bar 62 forward, increases the distance between the sensors 112 and the drum 190 and sliding the support bar 62 rearward decreases the distance between the sensors 112 and the applicator drum 190.

As discussed previously, when the sensors 112 detect the presence of a recess 22, they immediately activate a corresponding door actuator 180, thereby uncovering the lower end 156 of the corresponding tube 154. They also immediately activate a corresponding tube actuator 168 thereby releasing a portion of the filler material 26 onto the counter rotating drum 190. Obviously, there is some delay between the time when the door actuator 180 and tube actuator 168 are triggered and the time that the filler material 26 actually reaches the paved surface 20. Otherwise, the filler material 26 would miss the sensed recess 22. The design of the material spreading apparatus 10 assumes that the apparatus 10 is moving forward at a constant speed. The distance between the sensor 112 and the applicator drum 190 is then chosen so that the delay between the time that the door actuator 180 and tube actuator 168 are triggered and the time the filler material 26 reaches the paved surface 20 is approximately the same as the time it takes the material spreading apparatus 10 to cover a distance equal to distance between the sensor 112 and the area immediately behind the applicator drum 190. Therefore, the filler material 26 released by the tube 154 reaches the paved surface 20 at approximately the same time that the recess 22 is located to receive the filler material 26. As will be clear to one of skill in the art, if the speed of forward movement of the material spreading apparatus 10 is significantly increased or decreased, the filler material 26 released by a tube 154 may miss the sensed recess 22. Therefore, a means to adjust for changes in the speed of the material spreading apparatus 10 was needed.

Figure 14:
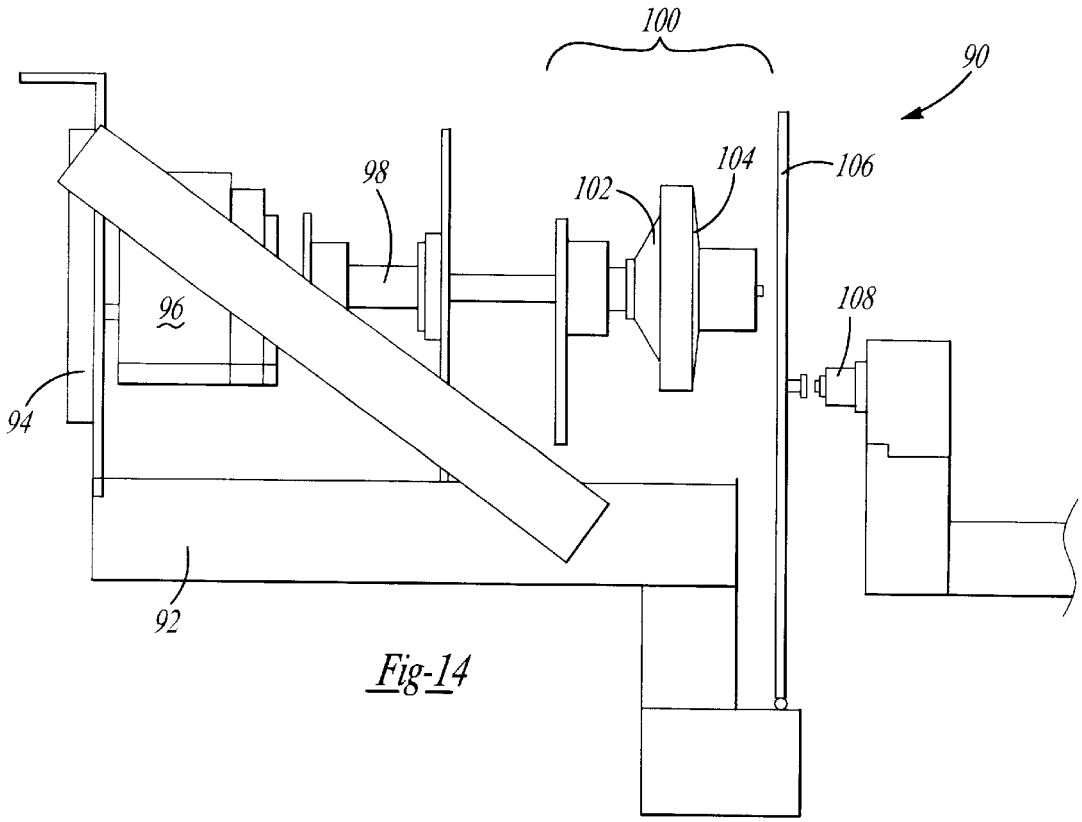
FIG. 14 is a rear view of one embodiment of a speed sensor for use with the present invention.

The slidable interconnection between the sensor support portion 60 of the frame 52 and the main portion 54 of the frame 52 helps to address the speed variance problem. By moving the sensors 112 forwardly and backwardly relative to the applicator drum 190, compensation can be made for changes in the forward speed of the material spreading apparatus 10. In the preferred embodiment, the support bar 62 is moved using a pair of pneumatic cylinders. The rear cylinder 76 is mounted to the main portion 54 of the frame 52 and has an actuator rod 78 extending forward from it. The front cylinder 80 is slidably supported on the main portion 54 of the frame 52 in front of the rear cylinder 76 and has an actuator rod 82 extending forward from it. The front cylinder 80 is positioned such that the actuator rod 78 from the rear cylinder 76 pushes against it thereby moving the front cylinder 80 towards the front 12 of the material spreading apparatus 10 when the actuator rod 78 on the rear cylinder 76 is extended. A bracket 84 is slidably supported on the main portion 54 of the frame 52 in front of the actuator rod 82 of the front cylinder 80 so that it is pushed forward when the actuator rod 82 of the front cylinder 80 is extended. The slidable bracket 84 has a lower portion 86 which extends downwardly behind the support bar 62 so that the support bar can be urged forward by the bracket 84. Therefore, when the rear cylinder 76 is actuated and extends its actuator rod 78, the front cylinder 80, the slidable bracket 84, the support bar 62, and the skids 64 are all moved forward by an amount equal to the stroke of the rear cylinder 76. If the front cylinder 80 is then also actuated, it extends its actuator rod 82 urging the slidable bracket 84, the support bar 62, and the skids 64 forward an additional distance equal to the stroke of the front cylinder 80. This creates a system that has three positions. The rearmost position of the support bar 62 and skids 64, as shown in FIG. 14, corresponds to neither the front or rear cylinder being actuated. This is the position which leads to proper timing and operation of the apparatus 10 when the material spreading apparatus 10 is moving at its minimum design speed. In one embodiment of the material spreading apparatus 10, this minimum design speed is approximately two miles per hour. When one of the cylinders is actuated, the support bar 62 and skids 64 are moved forward to a middle position, thereby increasing the distance between the sensors 112 and the applicator drum 190. The middle position corresponds to the material spreading apparatus 10 traveling in the forward direction at a somewhat greater speed than the minimum design speed of the apparatus 10.

Figure 15:
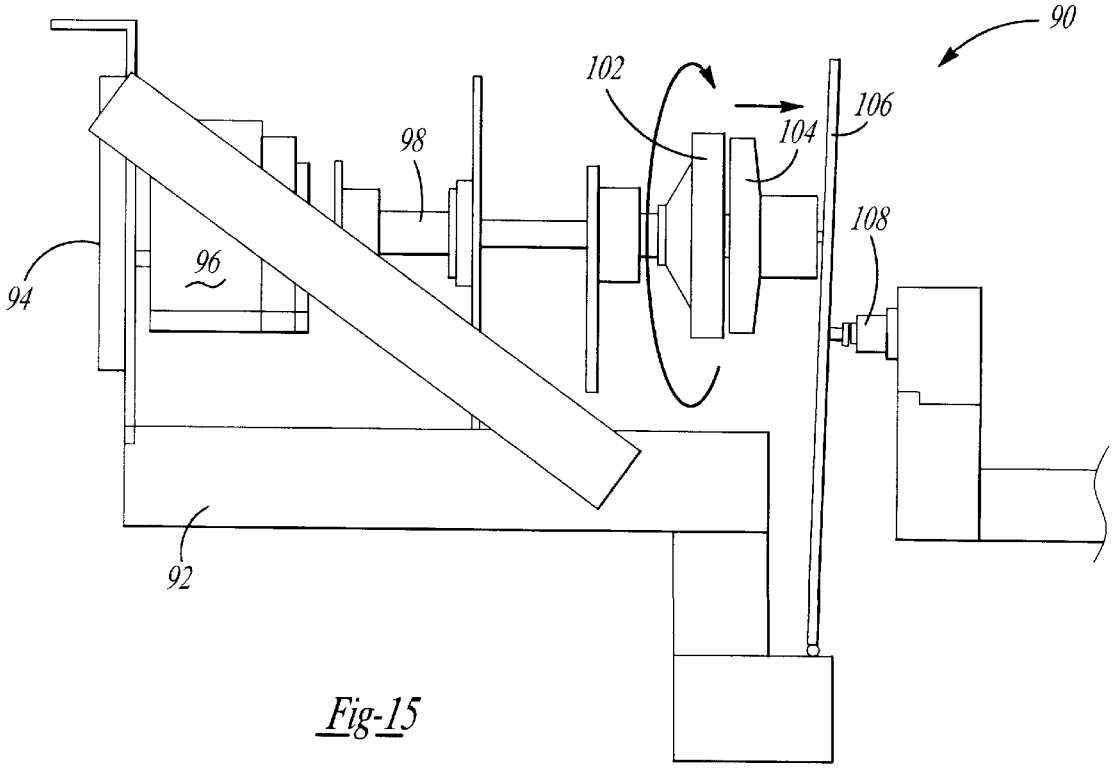
FIG. 15 is a rear view of the speed sensor of FIG. 14 showing the speed sensor triggering a speed limit switch.

When the second cylinder is also actuated, the support bar 62 and skids 64 are moved forward by an additional amount to the forwardmost position as shown in FIG. 15. This position corresponds to the fastest design speed of the material spreading apparatus 10.

In the illustrated embodiment, the front 80 and rear 76 cylinders are both one way cylinders. This means they only positively move in one direction. Air pressure is used to extend the actuator rods, but external force is required to retract the actuator rods back into the air cylinders. Therefore, the cylinders are not capable of pulling the slidable bracket 84, the support bar 62, the skids 64, and the sensors 112 rearwardly back from the forwardmost position to the rearwardmost position. Instead, the system relies on the forward motion of the material spreading apparatus 10 to return the support bar 62, and the skids 64 to the rearwardmost position. When air pressure is removed from the cylinders, they no longer hold the support bar 62 forward and therefore the friction between the skids 64 and the paved surface 20 tends to pull the support bar 62 and the skids 64 back to the rearwardmost position. This is a simple configuration for moving the sensors 112 relative to the applicator drum 190, but double acting cylinders or other return devices such as springs could be used to positively move the support bar and the skids from the forwardmost position to the rearwardmost position.

Preferably, the front 80 and rear 76 cylinder are triggered by some type of speed sensor, but alternatively could also be manually triggered.

Referring to FIGS. 14 and 15, one preferred embodiment of the speed sensor is shown. This mechanical speed sensor 90 includes an input pulley 94, a transmission 96, and a centrifugal cone clutch 100. The input pulley 94 is driven by the drive wheels 30 as shown in FIG. 4. The second drive pulley 36, which rotates with the drive wheels 30, drives a belt 38 which in turn drives the input pulley 94 for the mechanical speed sensor 90. The mechanical speed sensor 90 may be mounted in a variety of positions, but in the illustrated embodiment is mounted on the rear 14 of the frame 52 above the drive wheels 30. Returning to FIGS. 14 and 15, the mechanical speed sensor 90 has a base 92 for interconnecting it with the main portion 54 of the frame 52 of the apparatus 10. The input pulley 94, the transmission 96, and centrifugal cone clutch 100 are all supported by this base 92. The input pulley 94, driven by the drive wheels 30, in turn drives the transmission 96. The transmission 96 multiples the speed of the input pulley 94 thereby spinning an output shaft 98 at several times the speed of the input pulley 94. The output shaft 98 drives the centrifugal cone clutch 100. Those of skill in the art will recognize a centrifugal cone clutch 100 of this type as being similar to the cone clutches used in snowmobile transmissions. This centrifugal cone clutch 100 has a left half 102 and a right half 104 which spread apart as rotational speed of the clutch 100 increases. As shown in FIG. 14, the left 102 and right 104 halves of the centrifugal cone clutch 100 are nested. This nested configuration corresponds to low rotational speed of the centrifugal cone clutch 100. As the rotational speed of the centrifugal cone clutch 100 increases, the left 102 and right 104 halves spread apart as shown in FIG. 15. The amount that the left and right halves of the clutch spread apart is proportional to the rotational speed of the clutch 100. As the left 102 and right 104 halves spread apart, the right half 104 of the clutch 100 comes in contact with an output lever 106 thereby urging the output lever 106 toward the right. As the output lever 106 moves to the right, it comes in contact with a speed limit switch 108 mounted adjacent thereto. The transmission ratio, the pulley ratios, and the cone clutch 100 are chosen such that the rotational speed at which the clutch 100 forces the output lever 106 into the speed limit switch 108 corresponds to the forward speed of the material spreading apparatus 10 where one of the cylinders 76, 80 should be actuated thereby moving the support bar 62 and skids 64 forward. Though not illustrated, the preferred embodiment of the mechanical speed sensor 90 includes two limit switches, one triggered at a lower speed than the other. When the first limit switch is triggered, one of the pneumatic cylinders is actuated and when the second limit switch is triggered, the other pneumatic cylinder is also actuated.

As will be clear to one of skill in the art, the above discussed embodiment of the speed sensor and the actuators for moving the sensors is but one of many possible configurations. An electronic speed sensor can be substituted for the mechanical speed sensor or other types of mechanical speed sensors could be used. It would also be possible to modify the system and continuously vary the position of the support bar as a function of speed rather than moving it in discreet steps.

Figure 17:
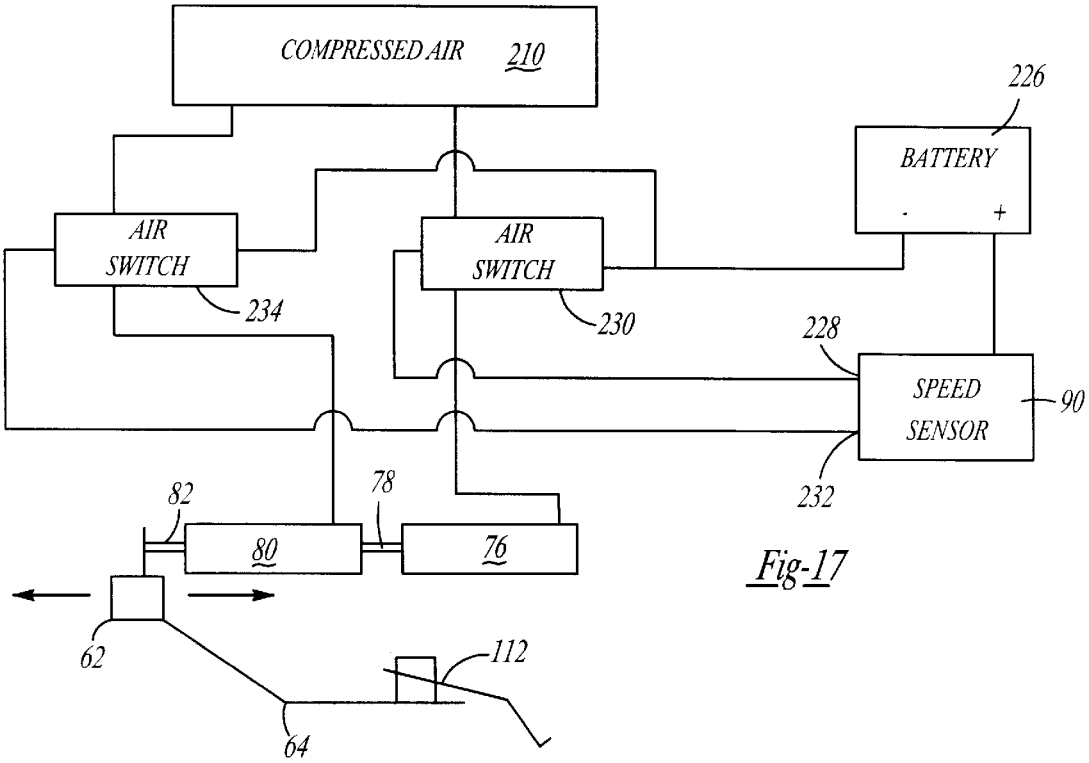
FIG. 17 is a diagram showing one approach to interconnecting a speed sensor and the actuator system of FIG. 12.

Referring now to FIG. 17, the interconnection and operation of the skid moving system is shown diagrammatically. A battery 226 provides power to a speed sensor 90 that has two outputs. The first output 228 is connected to a first air switch 230 and is energized at a first speed limit. The second output 232 is connected to a second air switch 234 and is energized at a second speed limit. Each air switch 230, 234 is connected to a compressed air source 210 and one of the cylinders for moving the sensor support 60. When one of the air switches is energized by the speed sensor, it interconnects the compressed air source with one of the cylinders, thereby causing the cylinder to extend.

As will be clear to one of skill in the art, the herein described preferred embodiments of the material spreading apparatus may be modified in various ways without departing from the inventive concept. One variation of the preferred embodiment is to add a propelling means to the apparatus 10 so that it does not have to be towed. Another variation is to modify the apparatus 10 to allow it to be mounted directly on the back of a truck so that it is supported directly thereby. The drive wheels could be eliminated and the various rotational parts of the machine could be driven in a different manner. It should be understood that the applicator drum is limited to being cylindrical. The "drum" could instead be a wide belt running on a two or more drive cylinders so as to fling filler material deposited thereon rearwardly and downwardly. Using such a belt also allows the use of more than one tube per treatment zone. In one embodiment of the present invention, a pair of mechanical sensors are disposed in each of the treatment zones, one triggered for shallow holes and both triggered for deeper holes. A pair of tubes are provided for each treatment zone with one triggered by each sensor. This embodiment provides increased flexibility for filling recesses of various depths but increases the complexity of the apparatus 10. This embodiment preferably has a wide belt version of the "drum" to allow the tubes to be placed fore and aft of each other.

In view of the teaching presented herein, other modifications and variations of the present invention will be readily apparent to those of skill in the art. The foregoing drawings, discussion, and description are illustrative of some embodiments of the present invention, but are not meant to be limitations on the practice thereof. It is the following claims, including all equivalents, which define the scope of the invention.

I claim:

1. A material spreading apparatus for filling recesses in a generally horizontal surface with an asphalt filler material, said apparatus movable in a forward direction over the generally horizontal surface so as to define a coverage path thereon, said coverage path comprised of a plurality of parallel treatment zones, said apparatus comprising a frame having a front, a back, and a pair of sides, said frame further including a main portion and a sensor support;

a plurality of sensors supported by said sensor support, said sensors spaced apart between the sides of the frame so that one of said sensors is disposed in each of the treatment zones, each sensor being responsive to the presence of a recess in its associated treatment zone; and a filling means supported by said frame and having a plurality of filling zones, one filling zone corresponding to each treatment zone, said filling means comprising a plurality of discrete containers having walls, said containers disposed transversely between the sides of the frame, each of said containers having a means connected to said walls for mechanically releasing the asphalt filler material from said container's walls, each of said containers further having an opening defined therein for expelling the asphalt filler material and a door for selectively covering said opening, one of said containers corresponding to each of said filling zones, each of said containers in communication with and activatable by said sensors so as to deposit filler material in one of the filling zones when the mechanical sensor disposed in the corresponding treatment zone senses the presence of a recess;

said sensor portion being movable with respect to said filling means so as to change a distance between said sensor portion and said filling means, said apparatus further comprising a speed sensor for sensing a speed of forward travel of said apparatus and an actuator for moving said sensor portion, said actuator responsive to said speed sensor and increasing the distance between said sensor portion and said filling means when the forward speed of said apparatus exceeds a predetermined speed limit.

2. The material spreading apparatus according to claim 1, wherein said filling means further comprises a counter rotating drum, said containers configured for depositing filler material onto said counter rotating drum when said mechanical sensors sense the presence of a recess, said counter rotating drum configured to urge filler material deposited thereon toward the sensed recess.

3. The material spreading apparatus of claim 1, wherein said discrete containers comprise parallel, generally vertical tubes.

4. The material spreading apparatus according to claim 1, wherein said sensor support comprises a plurality of skids, each skid pivotally interconnected with said main portion and supporting at least one of said sensors.

5. The material spreading apparatus according to claim 4, further comprising a skid lifting means for lifting said skids away from the generally horizontal surface.

6. The material spreading apparatus according to claim 1, wherein said sensors each comprise a sensor housing and a drag member pivotally interconnected with said sensor housing, each of said drag members having a contact end for contacting the generally horizontal surface, each of said mechanical sensors having an untriggered position and a triggered position, said contact end being lower when said mechanical sensor is in said triggered position than when said mechanical sensor is in said untriggered position.

7. The material spreading apparatus according to claim 6, further comprising a sensor lockout operable to prevent said drag members from pivoting to said triggered position.

8. A material spreading apparatus for filling recesses in a generally horizontal surface with a filler material, said apparatus movable in a forward direction over the generally horizontal surface so as to define a coverage path thereon, said coverage path comprised of a plurality of parallel treatment zones, said apparatus comprising a frame having a front, a back, and a pair of sides;

a sensing means supported by said frame and having a plurality of sensing zones, one of said sensing zones corresponding to each of the treatment zones, said sensing means being responsive to the presence of a recess in any one of said sensing zones; and a filling means supported by said frame for filling recesses sensed by said sensing means, said filling means comprising a container and a counter rotating applicator drum, said container configured for releasable holding a portion of the filler material, said container in communication with and activatable by said sensing means to deposit filler material onto said counter rotating applicator drum when said sensing means senses the presence of a recess in one of said sensing zones, said container comprising a plurality of parallel, generally vertical tubes, one of said tubes corresponding to each of said treatment zones, said tubes are each being defined by a first and a second elongated half, said halves movable relative to each other so that said tubes may be opened lengthwise, said counter rotating drum configured to urge filler material deposited thereon toward the sensed recess.

9. The material spreading apparatus of claim 8, wherein said container further comprises a plurality of tube actuators for opening said tubes, one of said tube actuators connected to each of said tubes, each of said tube actuators having a body interconnected with one of said tube halves and an actuator member interconnected with the other of said tube halves.

10. The material spreading apparatus of claim 8, wherein each tube includes an opening defined therein, a door for selectively covering said opening, and a door actuator operable to move said door between a position covering said opening and a position uncovering said opening.

11. A material spreading apparatus for filling recesses in a generally horizontal surface with a filler material, said apparatus movable in a forward direction over the generally horizontal surface so as to define a coverage path thereon, said coverage path comprised of a plurality of parallel treatment zones, said apparatus comprising a frame having a front, a back, and a pair of sides;

a sensing means supported by said frame and having a plurality of sensing zones, one of said sensing zones corresponding to each of the treatment zones, said sensing means being responsive to the presence of a recess in any one of said sensing zones;

a filling means supported by said frame and having a plurality of filling zones, one of said filling zones corresponding to each treatment zone and associated sensing zone, said filling means in communication with and activatable by said sensing means so as to deposit filler material in one of the filling zones when the sensing means senses the presence of a recess in the corresponding sensing zone;

said sensing means longitudinally repositionable with respect to said filling means so as to change a longitudinal distance between said sensing means and said filling means;

a speed sensor for sensing a speed of forward travel of said apparatus; and an actuator for longitudinally repositioning said sensing means, said actuator responsive to said speed sensor and increasing the longitudinal distance between said sensing means and said filling means when the forward speed of said apparatus exceeds a predetermined speed limit, so that repositioning of said sensing means compensates for changes in the forward speed of said apparatus.

12. The material spreading apparatus according to claim 11, wherein said sensing means comprises a plurality of sensors, said sensors spaced apart between the sides of the frame so that one of said sensors is disposed in each of the sensing zones, each sensor being responsive to the presence of a recess in its associated sensing zone.

13. The material spreading apparatus according to claim 12, wherein said frame includes a main portion and a sensor support, said plurality of sensors being supported by said sensor support, said sensor support comprising a plurality of skids, each skid pivotally interconnected with said main portion and supporting at least one of said mechanical sensors.

14. A material spreading apparatus for filling recesses in a generally horizontal surface with a filler material, said apparatus movable in a forward direction over the generally horizontal surface so as to define a coverage path thereon, said coverage path comprised of a plurality of parallel treatment zones, said apparatus comprising a frame having a front, a back, and a pair of sides;

a sensing means supported by said frame and having a plurality of sensing zones, one of said sensing zones corresponding to each of the treatment zones, said sensing means being responsive to the presence of a recess in any one of said sensing zones, a filling means supported by said frame and having a plurality of filling zones, one of said filling zones corresponding to each treatment zone and associated sensing zone, said filling means in communication with and activatable by said sensing means so as to deposit filler material in one of the filling zones when the sensing means senses the presence of a recess in the corresponding sensing zone, said filling means comprising a container and a counter rotating drum, said container configured for releasably holding a portion of the filler material, said container in communication with and activatable by said sensors to deposit filler material onto said counter rotating drum when said sensors sense the presence of a recess, said counter rotating drum configured to urge filler material deposited thereon toward the sensed recess, said container comprising a plurality of parallel, generally vertical tubes, one of said tubes corresponding to each of said treatment zones, said tubes each being defined by a first and a second elongated half, said halves movable relative to each other so that said tubes may be opened lengthwise, said sensing means movable with respect to said filling means so as to change a distance between said sensing means and said filling means;

a speed sensor for sensing a speed of forward travel of said apparatus; and an actuator for moving said sensing means, said actuator responsive to said speed sensor and increasing the distance between said sensing means and said filling means when the forward speed of said apparatus exceeds a predetermined speed limit.

15. The material spreading apparatus of claim 14, wherein said container further comprises a plurality of tube actuators for opening said tubes, one of said tube actuators connected to each of said tubes, each of said tube actuators having a body interconnected with one of said tube halves and an actuator member interconnected with the other of said tube halves.

* * * * *

UNITED STATES PATENT AND TRADEMARK OFFICE

CERTIFICATE OF CORRECTION

PATENT NO. : 6,113,310

DATED : September 5, 2000

INVENTOR(S) : Ronald Hesse Jr.

It is certified that error appears in the above-identified patent and that said Letters Patent are hereby corrected as shown below:

Column 18, line 22 - After "tubes" delete --are--.

Column 20, lines 6-7 - After "container" delete the following --in communication with and activatable by said sensors--.

Column 20, line 7 - Before "to" insert --operable--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*